US011890660B2

(12) United States Patent
Chen et al.

(10) Patent No.: US 11,890,660 B2
(45) Date of Patent: Feb. 6, 2024

(54) PREPARATION METHOD FOR METAL MATERIAL

(71) Applicant: SHANGHAI JIAO TONG UNIVERSITY, Shanghai (CN)

(72) Inventors: Fei Chen, Shanghai (CN); Guangshan Wu, Shanghai (CN); Zhenshan Cui, Shanghai (CN); Jiao Zhang, Shanghai (CN); Baode Sun, Shanghai (CN)

(73) Assignee: SHANGHAI JIAO TONG UNIVERSITY, Shanghai (CN)

( * ) Notice: Subject to any disclaimer, the term of this patent is extended or adjusted under 35 U.S.C. 154(b) by 0 days.

(21) Appl. No.: 17/894,124

(22) Filed: Aug. 23, 2022

(65) Prior Publication Data

US 2022/0402012 A1 Dec. 22, 2022

Related U.S. Application Data

(63) Continuation-in-part of application No. PCT/CN2021/119780, filed on Sep. 23, 2021.

(30) Foreign Application Priority Data

Dec. 11, 2020 (CN) ..... 202011436500.1

(51) Int. Cl.
*B21D 13/10* (2006.01)

(52) U.S. Cl.
CPC ..... *B21D 13/10* (2013.01)

(58) Field of Classification Search
CPC ..... B21D 13/10; B21D 13/02
See application file for complete search history.

(56) References Cited

U.S. PATENT DOCUMENTS 4,450,706 A * 5/1984 Engelmohr ..... B21D 13/02 72/385
2018/0304342 A1* 10/2018 Bry ..... F28F 21/084

FOREIGN PATENT DOCUMENTS

CN 105855345 8/2016
CN 106424261 2/2017
CN 107716668 2/2018
(Continued)

OTHER PUBLICATIONS

Machine translation of CN 10642261A1, pp. 1-4. (Year: 2023).*
(Continued)

*Primary Examiner* — Teresa M Ekiert
(74) *Attorney, Agent, or Firm* — JCIPRNET

(57) ABSTRACT

The present invention discloses a preparation method for a metal material, including: horizontally placing a to-be-prepared metal material between wavy surfaces of a female die and a male die; connecting a press machine with the male die; pressing the metal material through the male die, so that the metal material makes complete contact with the male die and the female die; ejecting the pressed metal material; horizontally overturning the metal material, and then placing the metal material between the wavy surfaces of the female die and the male die; repeatedly performing the pressing and overturning processes until accumulated strain of the metal material meets a requirement; and taking out the metal material after the deformed metal material is flattened by a plane die. According to the present invention, a large-size nano grained material can be manufactured.

12 Claims, 4 Drawing Sheets

(56) References Cited

FOREIGN PATENT DOCUMENTS

| | | |
|---|---|---|
| CN | 109059653 | 12/2018 |
| CN | 112588855 | 4/2021 |
| JP | 2001239319 | 9/2001 |

OTHER PUBLICATIONS

"International Search Report (Form PCT/ISA/210) of PCT/CN2021/119780", dated Dec. 2, 2021, with English translation thereof, pp. 1-4.

"Written Opinion of the International Searching Authority (Form PCT/ISA/237) of PCT/CN2021/119780", dated Dec. 2, 2021, pp. 1-5.

* cited by examiner

PREPARATION METHOD FOR METAL MATERIAL

CROSS-REFERENCE TO RELATED APPLICATION

This is a continuation-in-part application of International Application No. PCT/CN2021/119780, filed on Sep. 23, 2021, which claims the priority benefits of China Application No. 202011436500.1, filed on Dec. 11, 2020. The entirety of each of the above-mentioned patent applications is hereby incorporated by reference herein and made a part of this specification.

BACKGROUND

Technical Field

The present invention relates to the field of nano grained metal material preparation, and in particular to a preparation method for a large-size uniform-deformation nano grained metal material.

Description of Related Art

Grain refinement, serving as one of the most important strengthening mechanisms for metal material, is a hot spot for studies in the metal field all the time. However, it is still a great challenge to manufacture bulk materials with ultra-fine or nano grains using traditional processing technologies like casting and normal metal forming. Approaches for achieving great refinement of the metal material at the present stage are mainly divided into a top-to-bottom method and a bottom-to-top method. The bottom-to-top method refers to that structure refinement such as electrolytic deposition and gas condensation are achieved by regulating and controlling a metal solidification process. The top-to-bottom method mainly refers to severe plastic deformation, mainly including high-pressure torsion (HPT), constrained groove pressing (CGP), equal channel angular pressing (ECAP), reciprocating extrusion (RE), accumulative rolling (AR), and multi-direction forging (MDF). Gas condensation and other methods may be adopted for preparing an ultra-fine grain material, but a sample is small in size and has holes and other defects. On the other hand, ultra-fine grained bulk materials can be hardly prepared by severe plastic deformation. For example, high-pressure torsion and other severe plastic deformation technologies have strong grain refinement ability, but are similarly applicable to the preparation of small-size samples only, and deformation of a central area is low. Besides, although the size of sample for MDF and CGP is much bigger than that of ECAP and HPT, their strain accumulation in a single pass is relatively small, and the strain distribution is not homogeneous, which restrain their industrial application.

At present, in a high-pressure torsion test for a 6-series aluminum alloy, it is found that high-pressure torsion can obviously refine the microstructure and improve the strength thereof; and compared with an original material, the strength of the alloy is improved by 3 times after room-temperature high-pressure torsion. Twinning Induced Plasticity (TWIP) steel shows remarkable grain refinement as well as obvious improvement in the densities of twin and dislocation after being subjected to equal channel angular pressing. But the microstructure is nonuniform in macroscale. Meanwhile, with the increase in the pressing passes, the texture intensity of sample is gradually enhanced. And, for the pure aluminum subject to 4-pass (16-time deformation) constrained groove pressing at room temperature, the sizes of grains are refined to about 500 nanometers from original 100 microns; but the distribution of hardness is still uneven. Moreover, for the pure copper subject to 48 passes multi-direction forging, the grain size is reduced to about 1 micron; but grain refinement is uneven in the sample. Thus, for the industrial application, how to prepare a bulk nano grained material and simplify a processing technology is a key problem to be solved at present.

SUMMARY

The present invention aims to solve the technical problems about how to prepare a bulk uniform nano grained material meeting an industrial application requirement and simplify a processing technology and provides a preparation method for a metal material.

Disclosed is a preparation method for a metal material, the preparation method including:

- horizontally placing a to-be-prepared metal material between wavy surfaces of a female die and a male die;
- starting a press machine which is connected to the male die, and pressing the metal material through the male die, so that the metal material can make a complete contact with the male die and the female die;
- ejecting the pressed metal material, horizontally overturning the metal material, and then placing the metal material between the wavy surfaces of the female die and the male die;
- repeatedly performing the pressing process, ejecting a re-pressed metal material, horizontally overturning the metal material again, and then, placing the metal material between the wavy surfaces of the female die and the male die;
- repeatedly performing pressing and overturning processes until accumulated strain of the metal material meets a requirement; and
- taking out the metal material after the deformed metal material is flattened by a plane die.

Preferably, the male die and the female die are made of die steel, and the metal material may be pure metal or an alloy.

Preferably, wavy surface features of the male die and the female die are staggered, and the male die may be completely attached to the female die.

Further, the wavy surface features include a wave height (h), a wave width (w) and a feature radian.

Preferably, strain generated after one-time pressing is in positive correlation with the feature radian.

Preferably, an upper limit of a thickness of the to-be-prepared metal material is in positive correlation with the wave form height h and the wave form width w.

Further, the male die and the female die may be exchanged for use; and during repeated pressing, protruding parts of the metal material make contact with protruding parts of the male die and the female die.

On the basis of conforming to general knowledge in the art, above preferable conditions can be combined at will so that various better examples of the present invention can be obtained.

The present invention has positive and advanced effects that a bulk nano grained material can be prepared; the microstructure refinement ability is higher, deformation is more uniform, and a machining process is simpler; and macroscopic texture defects can be inhibit, and the isotropic nano grained material with uniform grain size distribution may be obtained.

DESCRIPTION OF THE EMBODIMENTS

Figure 1:
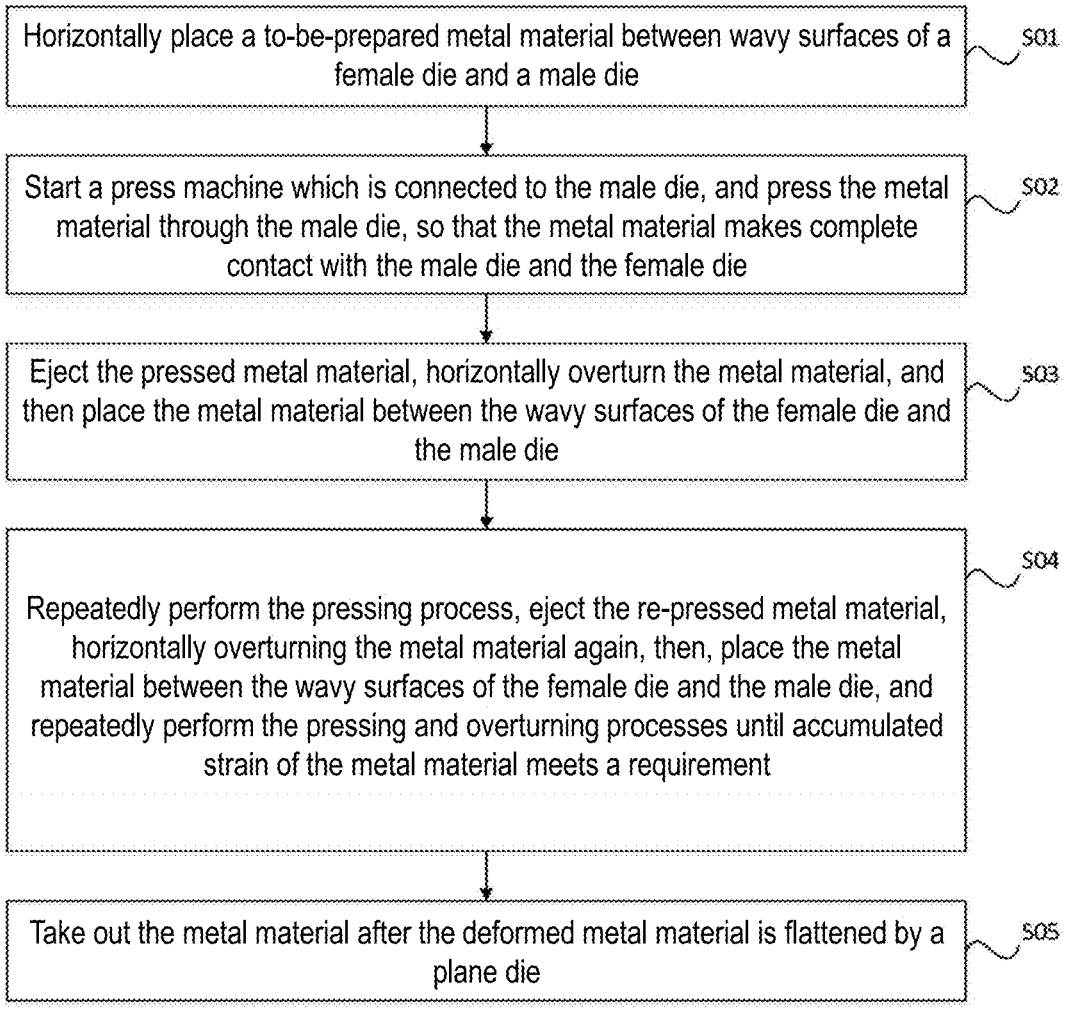
FIG. 1 is a flow chart of a method according to an embodiment of the present invention.

FIG. 1 is a flow chart of a preparation method for a metal material of the present invention:

S01: A to-be-prepared metal material is horizontally placed between wavy surfaces of a female die and a male die.

Figure 3:
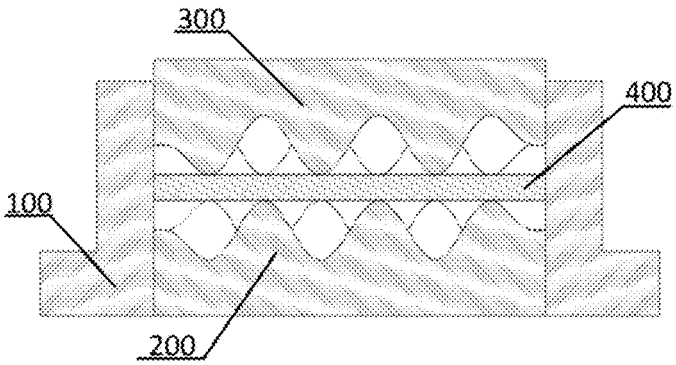
FIG. 3 is a schematic diagram of a metal material placed into a die according to an embodiment of the present invention.

In an example, as shown in FIG. 1 and FIG. 3, a metal material 400 is horizontally placed between wavy surfaces of a female die 200 and a male die 300, where a die outer ring 100 is used for limiting circumferential movements of the female die 200, the male die 300 and the metal material and guiding the movements of the female die 200 and the male die 300; the metal material 400 may be pure metal or an alloy such as an aluminum alloy and a magnesium alloy; and the male die 300 and the female die 200 are generally made of die steel which may be preferably H15 die steel.

S02: A press machine is started which is connected to the male die, and the metal material is pressed through the male die, so that the metal material makes complete contact with the male die and the female die.

Figure 2:
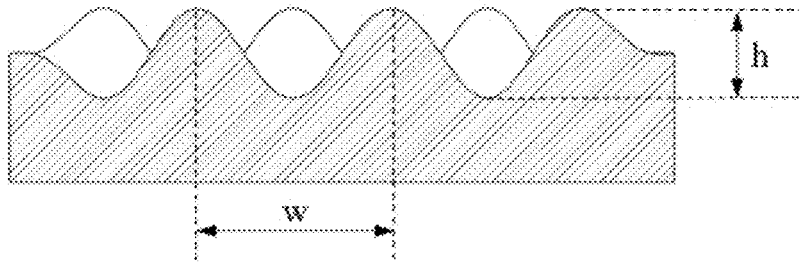
FIG. 2 shows a wavy surface characteristic of a die according to an embodiment of the present invention.
Figure 4:
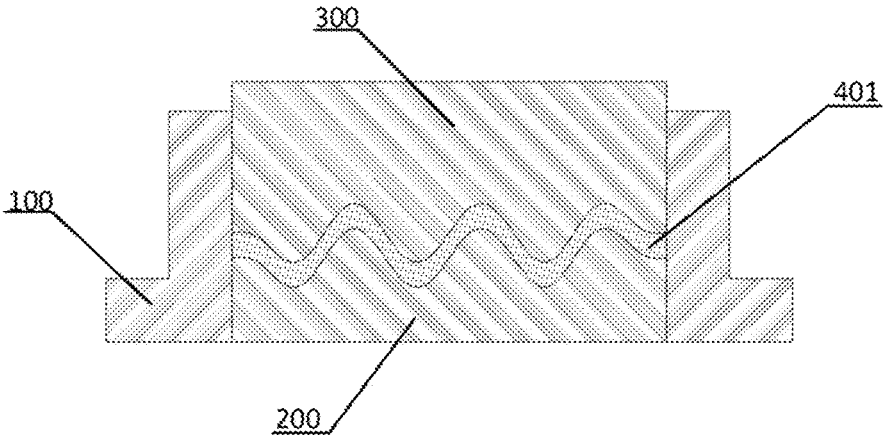
FIG. 4 is a schematic diagram that a metal material is subjected to pressing deformation according to an embodiment of the present invention.
Figure 5:
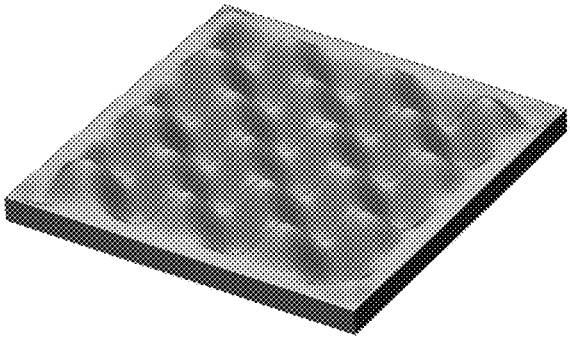
FIG. 5 is a schematic diagram of a blank after one-time deformation on a metal material according to an embodiment of the present invention.

In an example, as shown in FIG. 1, FIG. 2 and FIG. 4, the press machine connected to the male die 300 presses, through the male die 300, a metal material 401 placed between wavy surfaces; the wavy surfaces of the male die 300 and the female die 200 are staggered; and during pressing operation, the male die 300, the female die 200 and the metal material 401 may be completely attached. As shown in FIG. 2, wavy surface features of each of the male die and the female die include a waveform height (h), a waveform width (w) and a feature radian, where when the waveform height (h) and the waveform width (w) are enlarged in an equal proportion, an upper limit of a formable thickness of the to-be-processed metal material may be increased as well; and with the feature radian is enlarged, strain accumulation in a single-pass is increased. Through early simulation study and comprehensive consideration of strain uniformity, strain accumulation ability and service life of a die, a following feature size is recommended: to-be-prepared metal material thickness=(½)h=(¼)w. Existing studies show that through constrained groove pressing, rolling, extruding and other deformation technologies, flow trajectories of metal are consistent, which can cause an anisotropy (namely, texture) defect; a plate formed through constrained groove pressing and other technologies is non-uniform in microstructure distribution as well as mechanical properties. And the above defects are hard to be eliminated by increasing the number of deformation passes. As shown in FIG. 5, the wave surface of the die is smooth in all directions, which guarantees deformation uniformity of the to-be-machined metal material in the deformation process. Finally, an isotropic metal plate with uniform microstructure distribution is obtained. In addition, the positions of the male die 300 and the female die 200 are exchangeable for use.

S03: The pressed metal material is ejected, and the metal material is horizontally overturned and then placed between the wavy surfaces of the female die and the male die.

Figure 6:
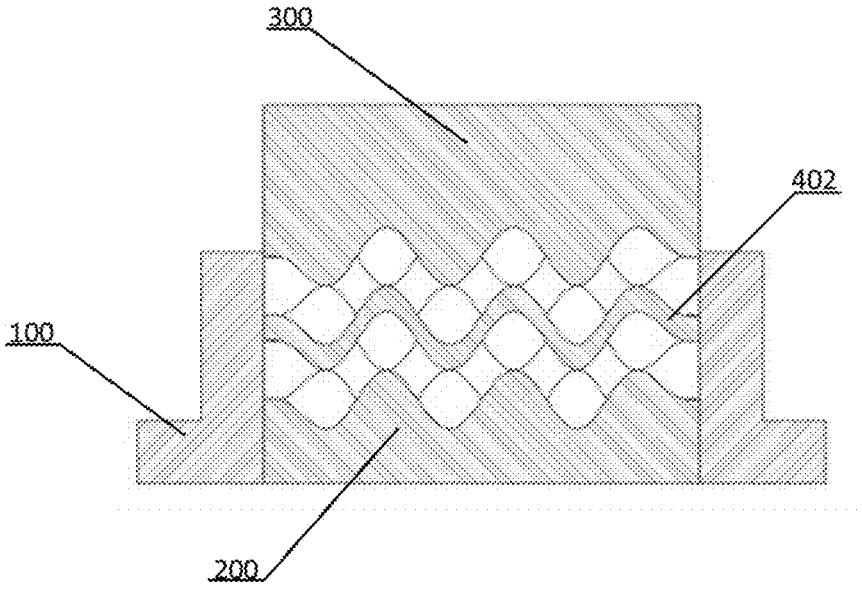
FIG. 6 is a schematic diagram of a metal material overturned for re-deformation according to an embodiment of the present invention.

In an example, as shown in FIG. 1 and FIG. 6, after being ejected by an ejection device of the press machine, the pressed metal material is horizontally overturned and then placed between the wavy surfaces of the female die 200 and the male die 300; and wavy peak parts of a metal material 402 make contact with wavy peak parts of the female die 200 and the male die 300 so as to realize the strain accumulation of material in the pressing deforming process.

S04: The pressing process is repeatedly performed, a re-pressed metal material is ejected, horizontally overturned again and then placed between the wavy surfaces of the female die and the male die, and pressing and overturning processes are repeatedly performed until accumulated strain of the metal material meets a requirement.

In an example, as shown in FIG. 1, the horizontally overturned metal material is pressed again, the process of horizontal overturning-pressing-horizontal overturning-pressing is repeatedly performed until accumulated strain of the metal material meets a requirement. Generally, the higher the number of cycles is, the larger the accumulated strain of the metal material becomes; and normally, the grain size of metal material may be refined into a nanoscale if the accumulated strain reaches about 4. In the prior study, traditional constrained groove pressing needs 16 times deformation to achieve this strain, while the present invention only needs 5 times deformation, such that the manufacturing process of the bulk nano grained metal material is greatly simplified.

S05: The deformed metal material characterized by the waveform is flattened by a plane die, and then the plat with refined microstructure can be taken out.

A die structure feature of the present invention is of a three-dimensional waveform structure rather than a kind of simple rotation or stretching of a two-dimensional waveform feature. The waveform feature can lead to distinct metal flow trajectories in adjacent areas during deformation. Therefore, the problem of centralized of crystal orientation, i.e., the texture may be effectively prevented.

According to the present invention, due to expansion from two-dimensional deformation to three-dimensional deformation, the metal is subjected to more severe shear deformation in the deformation process. Through a finite element simulated result, the accumulated strain of one-time deformation is about 1, and the strain state is mainly shear. Whereas the strain accumulation of four-time constrained groove pressing deformation is about 0.5. At present, a 7-series aluminum alloy is subjected to four-time deformation by the present deformation at 390° C., and the average grain size is refined from about 300 microns to about 800 nanometers.

Figure 8:
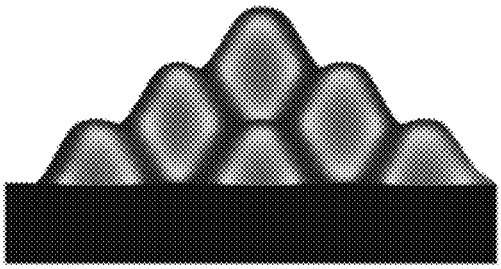
FIG. 8 and FIG. 9 are schematic diagrams of waveform features of different arrangements and combinations.
Figure 9:
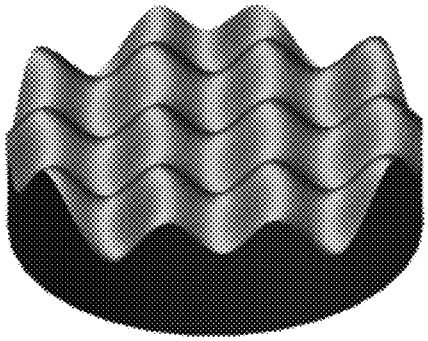

The existing processing technology for a nano grained material, including high-pressure torsion, equal channel angular pressing, constrained groove pressing and multi-direction forging, have strict requirements for shapes of samples. For these technologies, only small size disk can be processed through high-pressure torsion, only bar-like samples can be processed through equal channel angular pressing, only square plates can be processed through constrained groove pressing, and only square samples can be processed through multi-direction forging. However, the technology provided by the present invention is suitable for preparing plates in various shapes, and only needs to change the arrangement of waveform features according to actual situations. For example, when products actually required are triangular plates or circular plates or of other structures, the features can be arranged and combined at will to prepare the implemented products, as shown in FIG. 8 and FIG. 9.

Figure 10:
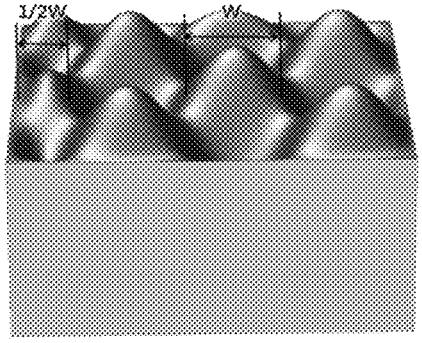
FIG. 10 and FIG. 11 are schematic diagrams of sizes and distribution regulation and control of waveform features.
Figure 11:
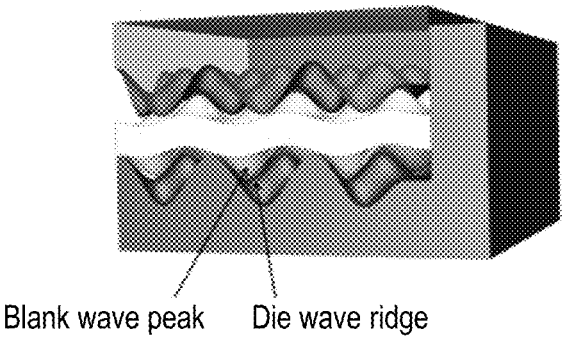

In addition, the present invention may change deformation mechanism and formability of the metal by adjusting the waveform features, and further improve refinement extreme of microstructure. As shown in FIG. 10 and FIG. 11, the width and height of waveform features in the edge area of the die are only half of the waveform features in middle area. By using this characterized structure, the relative positions between the sample and die after each pass PUC deformation are exchanged, and consequently improves the deformation uniformity of the plate after multi-pass PUC deformation. Specifically, the ridge region of the sample and the crest region of die, as well as the crest region of the sample and the rigid region of die will contact with each other after turning over the sample horizontally. Furthermore, the same area of a plate may be subjected to different-direction shear deformation in the multi-pass deformation process. This may improve the formation of a staggered micro shear band and refinement of the microstructure. In addition, it is found through existing finite element simulation and experiment results that the multi-pass formability of the plate may be further improved by optimizing feature distribution and sizes, while a bending area of the plate subjected to a traditional constrained groove pressing technology is easy to crack in the deformation process.

Figure 7:
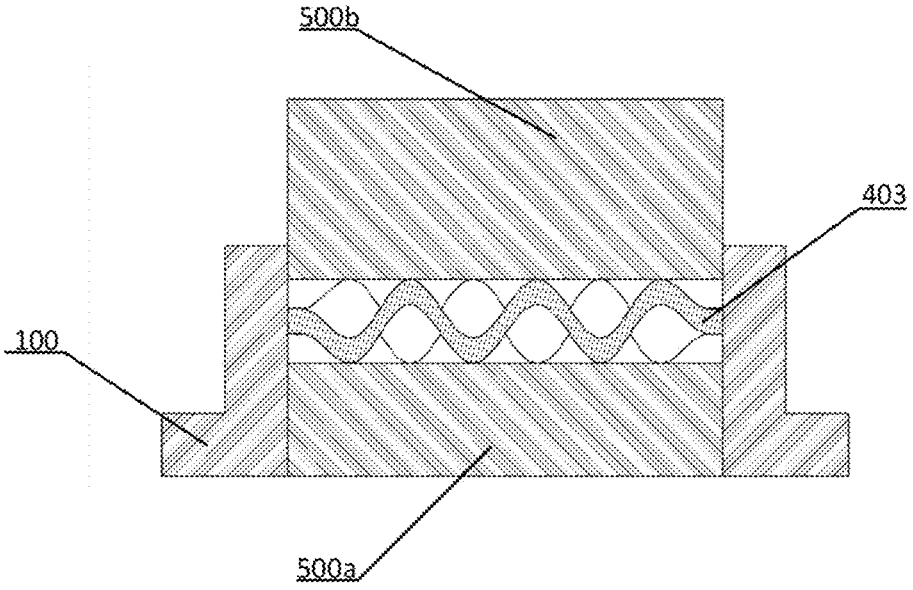
FIG. 7 is a schematic diagram of flattening a final metal material in according to embodiment of the present invention.

In an example, as shown in FIG. 1 and FIG. 7, after the strain of the metal material meets the requirement after multi-pass pressing, the ejection device of the press machine ejects the deformed metal material from the die, and the deformed metal material 403 is flattened by the plane die. The plane die includes a lower plane die 500*a* and an upper plane die 500*b*. The deformation ability of the present invention is significantly higher than that of constrained groove pressing. Specifically, the accumulated strain of five-step deformation is higher than that of 16-step deformation of constrained groove pressing, and the strain uniformity is obviously enhanced.

What is claimed is:

1. A preparation method for a metal material, comprising:

horizontally placing a to-be-prepared metal material between wavy surfaces of a female die and a male die, wherein the female die and the male die respectively include a plurality of first mountain-shaped features having the wavy surfaces, and the plurality of first mountain-shaped features are substantially identical;

starting a press machine which is connected to the male die, and pressing the metal material through the male die, so that the metal material makes complete contact with the male die and the female die;

ejecting the pressed metal material, horizontally overturning the metal material, and then placing the metal material between the wavy surfaces of the female die and the male die, wherein the pressed metal material has a plurality of second mountain-shaped features;

repeatedly performing the pressing process, ejecting a re-pressed metal material, horizontally overturning the re-pressed metal material again, then, placing the re-pressed metal material between the wavy surfaces of the female die and the male die, and repeatedly performing the pressing and overturning processes until accumulated strain of the metal material meets a requirement; and taking out the metal material after the deformed metal material is flattened by a plane die.

2. The preparation method for the metal material according to claim 1, wherein the male die and the female die are made of die steel, and the metal material includes pure metal or an alloy.

3. The preparation method for the metal material according to claim 1, wherein the plurality of second mountain-shaped features of the pressed metal material after the horizontally overturning and the plurality of first mountain-shaped features of the male die and the female die are staggered from each other.

4. The preparation method for the metal material according to claim 3, wherein the plurality of first mountain-shaped features comprise a feature height (h), a feature width (w) and a feature radian.

5. The preparation method for the metal material according to claim 4, wherein strain accumulated after one-time pressing is increased when the feature radian is increased.

6. The preparation method for the metal material according to claim 5, wherein an upper limit of a thickness of the to-be-prepared metal material is increased when the feature height (h) and the feature width (w) are increased.

7. The preparation method for the metal material according to claim 1, wherein the male die and the female die can be exchanged for use; and during repeated pressing, peak parts of the metal material make contact with peak parts of the male die and the female die.

8. The preparation method for the metal material according to claim 2, wherein the male die and the female die can be exchanged for use; and during repeated pressing, peak parts of the metal material make contact with peak parts of the male die and the female die.

9. The preparation method for the metal material according to claim 3, wherein the male die and the female die can be exchanged for use; and during repeated pressing, peak parts of the metal material make contact with peak parts of the male die and the female die.

10. The preparation method for the metal material according to claim 4, wherein the male die and the female die can be exchanged for use; and during repeated pressing, peak parts of the metal material make contact with peak parts of the male die and the female die.

11. The preparation method for the metal material according to claim 5, wherein the male die and the female die can be exchanged for use; and during repeated pressing, peak parts of the metal material make contact with peak parts of the male die and the female die.

12. The preparation method for the metal material according to claim 6, wherein the male die and the female die can be exchanged for use; and during repeated pressing, peak parts of the metal material make contact with peak parts of the male die and the female die.

* * * * *